United States Patent [19]

Herubel

[11] Patent Number: 4,525,002

[45] Date of Patent: Jun. 25, 1985

[54] DEVICE FOR APPLYING A BINDING ON A FLEXIBLE TUBULAR PACKING, AND IMPROVED BINDING THEREFOR

[75] Inventor: Jean-Frédéric Herubel, Guebwiller, France

[73] Assignee: N. Schlumberger & Cie, France

[21] Appl. No.: 356,470

[22] Filed: Mar. 9, 1982

[30] Foreign Application Priority Data

Mar. 10, 1981 [FR] France ..... 81 04714

[51] Int. Cl.[3] ..... A01D 59/04; B65H 69/04

[52] U.S. Cl. ..... 289/2; 289/18.1

[58] Field of Search ..... 289/1.2, 2, 17, 18.1

[56] References Cited

U.S. PATENT DOCUMENTS

| | | | |
|---|---|---|---|
| 876,573 | 1/1908 | Myers | 289/17 |
| 2,677,487 | 5/1954 | Friedman | 289/18.1 |
| 3,318,623 | 5/1967 | Borroso | 289/18.1 X |
| 3,940,169 | 2/1976 | Kock | 289/18.1 X |

FOREIGN PATENT DOCUMENTS

| | | | |
|---|---|---|---|
| 712012 | 10/1941 | Fed. Rep. of Germany . | |
| 1187512 | 2/1965 | Fed. Rep. of Germany . | |
| 1632109 | 6/1971 | Fed. Rep. of Germany . | |
| 859478 | 12/1940 | France . | |
| 2310927 | 12/1976 | France . | |
| 518606 | 3/1940 | United Kingdom | 289/18.1 |

*Primary Examiner*—Louis Rimrodt

[57] ABSTRACT

A device for applying a knot-shaped binding onto the end of a flexible tubular packing, particularly a pork-butchery article, characterized in that it comprises: a hollow mandrel for receiving the narrowed end of the packing, said mandrel being adapted for receiving on its cylindrical outer peripheral surface a previously prepared knot-shaped binding; a sliding push-piece adapted for sliding the binding over the mandrel for ejecting it therefrom and transferring it onto the narrowed end portion of the packing protruding from the mandrel; and suction means for the narrowed free end through the mandrel in order to stretch it axially during the application of the knot.

6 Claims, 2 Drawing Figures

DEVICE FOR APPLYING A BINDING ON A FLEXIBLE TUBULAR PACKING, AND IMPROVED BINDING THEREFOR

This invention relates to a device for applying a knot-shaped binding onto an end of a flexible tubular packing in order to close it. It relates also to a particular knot-shaped binding arrangement.

Its preferential application is in the field of the closing of a natural or synthetic casing of a pork-butchery article, hereafter called saussage, containing a pasty mass such as saussage-meat.

Hitherto, in order to close a saussage with a knot-shaped binding, the process was carried out manually. The casing being filled, the operator closed the end with a knot which he had to completely make up on the spot. Such operations were lengthy, delicate, irregular and not always reliable. The disadvantages of such a manual technique were further aggravated when the knot had to be provided with a free loop by which the saussage was subsequently handled and hung for a treatment or its display for sale.

An object of this invention is to provide a device for applying a knot-shaped binding on the end of a packing, without direct manual intervention.

A further object of this invention is to provide a knot-shaped binding comprising, in its structure, a free loop.

The device according to the invention and provided for applying a knot-shaped binding on the end of a flexible tubular packing is characterized in that it comprises: a hollow mandrel for receiving the packing narrowed free end, said mandrel being adapted for receiving on its cylindrical outer peripheral surface a previously prepared knot-shaped binding; a sliding push-piece adapted for sliding the binding on the mandrel for ejecting it therefrom and transferring it onto the narrowed end portion of the packing protruding from the mandrel; and suction means for the narrowed free end through the mandrel in order to stretch it axially during the application of the knot.

Preferably, clamping means are provided, at a small axial distance from the mandrel, for keeping the packing end in its narrowed shape.

The knot-shaped binding according to the invention is characterized in that its is made of a double strand or run forming at one end a returning free loop, the structure of the knot comprising, from the end opposite the loop, two successive turns and a joining portion with the loop passing underneath the four strands of the turns.

Preferably, the second turn overlaps the first crosswise.

Thereby is obtained a self-tightening knot having a free loop and capable, due to the presence of the two turns, viz. the four strands, to efficiently tighten the packing without damaging it, due to the large contact surface.

Figure 1:
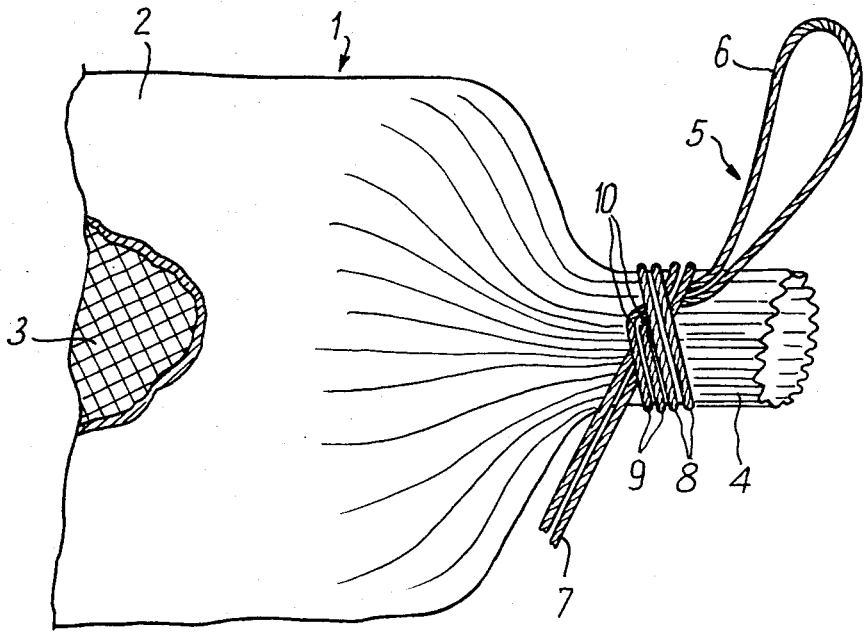
Figure 2:
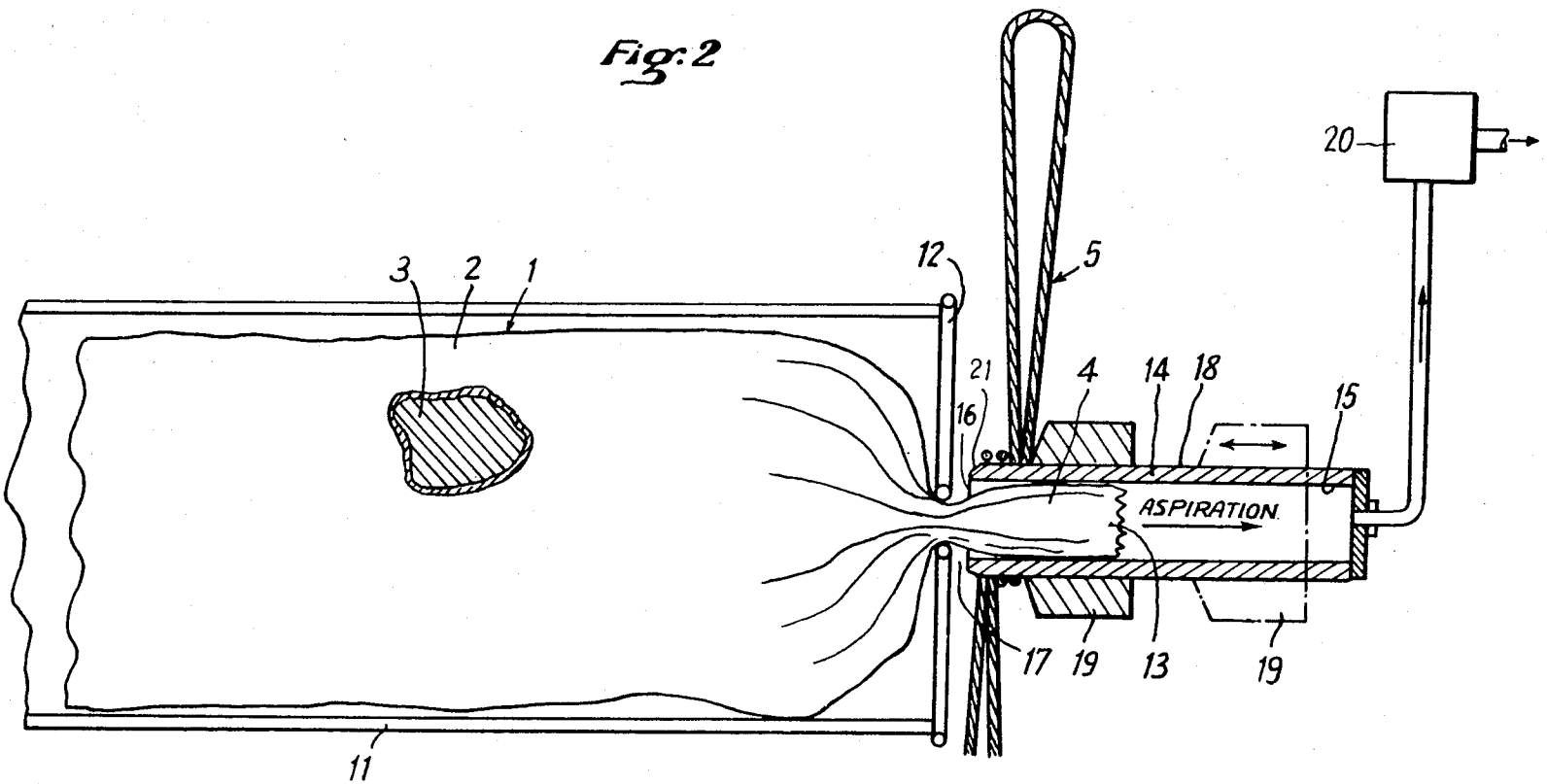

The invention will become more apparent when reading the following description with reference to the appended drawings which are part of the description and in which:

FIG. 1 is a perspective view showing the binding structure according to the invention, applied to a pork-butchery article, the binding being shown not completely tightened for clarity's sake, and FIG. 2 is an axial sectional view of the device according to the invention for applying a knot-shaped binding.

There is shown schematically in FIG. 1 a pork-butchery article 1, or saussage, comprising an outer envelope 2, called casing, which is natural or synthetic, containing a food product 3 such as a saussage-paste.

At one end, viz. that from which it is filled, the casing 2 comprises a narrowed region 4 onto which is applied a knot-shaped binding 5 having a free loop 6, and which is self-tightening.

As previously indicated, the loop 6 is provided for hanging the saussage for its handling, its treatment or its display for sale.

The knot 5 is obtained from a flexible tie of the string, cord, ribbon or similar type. This tie is bent over itself in the shape of a flattened "U" in order to initially form a loop 6 from which start two parallel strands, or double strand, remaining in this state during the forming of the knot.

In order to make the knot manually or automatically by starting from the free end 7 opposite the loop, there are formed around the end region 4 of the envelope 2 two succesive turns 8, 9, then the joining region 10 connecting the end of the second turn 9 of loop 6 is passed under the four strands of the turns, and a pull is simultaneously applied into the loop 6 and the free end 7 in order to secure the knot.

Thus is provided a self-tightening knot since the pull applied on the loop 6, in use, results into a pressure applied on the two inlet strands.

The self-tightening effect is further enhanced when, as is shown, the second turn 9 overlaps the first turn 8 crosswise.

In use, the effort to which the end region 4 of the envelope 2 is subjected by the knot is regularly distributed over the periphery and a large contact surface is provided by the two double strands. There is therefore no risk of damaging it.

A description will now be given, with reference to FIG. 2, of the device according to the invention which allows making a knot-shaped binding on the end region 4 of envelope 2.

The envelope 2 being filled with the food product 3 by way of operations and methods which are not part of this invention and therefore are not described here, the saussage is placed in a trough or gutter-shaped support 11 and a resilient clamp 12 temporarily tightenes the region 4 at a distance from the free edge 13 in order to define a non filled envelope length provided for receiving a knot-shaped binding.

The end region 4 is introduced into a hollow mandrel 14 having an inner channel 15 which, on the side opposite its envelope receiving end, is connected to a suction source, shown schematically at 20, provided for maintaining region 4 in a stretched state.

The arrangement is such that between clamp 12 and the end face 16 of mandrel 4 remains an axial space 17 sufficient for receiving the binding.

The binding which is advantageously the knot 5 of FIG. 1 is previously placed in a non-tightened state on the cylindrical and smooth outer peripheral surface 18 of mandrel 14, close to the end face 16.

On the peripheral surface 18, a cylindrical push-piece 19 can slide axially, under the control of non-shown power means. The function of the push-piece 19 is to slide knot 5, prepared and in a waiting position on the mandrel, onto region 4, in space 17. The radial play existing between mandrel 14 and push-piece 19 is small, so that there is no risk of squeezing a strand of knot 5. On the other hand, the engagement of the push-piece with the knot is continuous over the whole periphery, thereby preventing any deformation of the knot while sliding. Finally, the radial face 16 of the mandrel which is turned toward the saussage is advantageously chamfered or bevelled, as shown at 21, thereby eliminating any sharp edge likely to deform the knot during its transfer from the mandrel onto the envelope.

When the free end 13 of the envelope is in channel 15, the suction created by the device 20 stretches efficiently said end 13 in the axial direction so that the knot 5 is placed with certainty onto the envelope portion which is closest to clamp 12.

When the push-piece 19 is operated, the knot 5 is pushed into the narrow space 17. Then, the operator needs only to tightenen the knot, as indicated with reference to FIG. 1. The mandrel is then retracted from saussage 1, thus closed, said saussage subsequently leaving the support 11 once the clamp 12 is opened.

The operations for forming the knot, controlling the device movements, and tightening the knot can be carried out manually or automatically.

What I claim is:

1. A device for applying a knot-shaped binding on the end of a flexible tubular packing, particularly a pork-butchery article, comprising a hollow mandrel for receiving the narrowed end of the packing, said mandrel being adapted for receiving on its cylindrical outer peripheral surface a previously prepared knot-shaped binding; a sliding push-piece adapted for sliding the binding on the mandrel for ejecting it therefrom and transferring it onto the narrowed end portion of the packing protruding from the mandrel; and suction means for the narrowed free end through the mandrel in order to stretch it axially during the application of the knot.

2. A device according to claim 1, wherein clamping means, such as a clamp, are provided at a small axial distance from the mandrel for keeping the packing end in its narrowed shape.

3. A device according to claim 1, characterized in that it comprises a trough or gutter-shaped support for the packing.

4. A device according to claim 1, wherein the push-piece surrounds the mandrel over its whole periphery.

5. A device according to claim 1, wherein the push-piece has, with the mandrel outer surface, a small radial play.

6. A device according to claim 1, wherein the mandrel radial face which is turned toward the packing is chamfered.

* * * * *